US011415014B2

(12) United States Patent
Whittle et al.

(10) Patent No.: US 11,415,014 B2
(45) Date of Patent: Aug. 16, 2022

(54) TURBINE VANE ASSEMBLY WITH REINFORCED END WALL JOINTS

(71) Applicants: Rolls-Royce plc, London (GB); Rolls-Royce Corporation, Indianapolis, IN (US)

(72) Inventors: Michael J. Whittle, London (GB); Daniel K. Vetters, Indianapolis, IN (US); Jeffrey A. Walston, Indianapolis, IN (US); Eric Koenig, Fishers, IN (US)

(73) Assignees: Rolls-Royce plc; Rolls-Royce Corporation, Indianapolis, IN (US)

( * ) Notice: Subject to any disclaimer, the term of this patent is extended or adjusted under 35 U.S.C. 154(b) by 0 days.

(21) Appl. No.: 17/170,339

(22) Filed: Feb. 8, 2021

(65) Prior Publication Data

US 2021/0254485 A1 Aug. 19, 2021

Related U.S. Application Data

(62) Division of application No. 16/133,226, filed on Sep. 17, 2018, now Pat. No. 10,934,870.

(51) Int. Cl.
*F01D 9/04* (2006.01)
*F01D 5/28* (2006.01)

(52) U.S. Cl.
CPC ..... *F01D 9/044* (2013.01); *F01D 5/282* (2013.01); *F01D 9/041* (2013.01); *F05D 2230/237* (2013.01); *F05D 2240/12* (2013.01); *F05D 2300/6033* (2013.01); *F05D 2300/702* (2013.01)

(58) Field of Classification Search
CPC ..... F01D 9/044; F01D 5/282; F01D 5/284; F01D 9/041; F01D 9/042; F01D 11/005; F01D 5/147; F01D 5/189; F01D 9/02; F01D 5/3053; F01D 5/3084; F05D 2230/23; F05D 2230/237; F05D 2230/64; F05D 2240/12; F05D 2240/307; F05D 2240/80; F05D 2260/36; F05D 2260/30; F05D 2300/6033; F05D 2300/23; F05D 2300/603; F05D 2300/6012; F05D 2300/6034; F05D 2300/702
See application file for complete search history.

(56) References Cited

U.S. PATENT DOCUMENTS

| | | | | |
|---|---|---|---|---|
| 5,272,869 | A | 12/1993 | Dawson et al. | |
| 5,332,360 | A | 7/1994 | Correia et al. | |
| 5,630,700 | A * | 5/1997 | Olsen | F01D 9/042 415/209.2 |
| 6,200,092 | B1 | 3/2001 | Koschier | |
| 6,648,597 | B1 | 11/2003 | Widrig et al. | |
| 8,357,323 | B2 | 1/2013 | Morrison et al. | |
| 8,714,920 | B2 | 5/2014 | Campbell et al. | |
| 8,770,930 | B2 | 7/2014 | Merrill et al. | |
| 8,956,112 | B2 | 2/2015 | Tanahashi et al. | |
| 9,790,802 | B2 | 10/2017 | Herraiz et al. | |
| 9,970,307 | B2 | 5/2018 | Kanjiyani et al. | |
| 2005/0254942 | A1 | 11/2005 | Morrison et al. | |
| 2015/0003989 | A1 | 1/2015 | Uskert et al. | |
| 2015/0016972 | A1 | 1/2015 | Freeman et al. | |

(Continued)

*Primary Examiner* — Eric J Zamora Alvarez
(74) *Attorney, Agent, or Firm* — Barnes & Thornburg LLP

(57) ABSTRACT

The present disclosure is related to turbine vane assemblies comprising ceramic matrix composite materials. The turbine vane assemblies further including reinforcements that strengthen joints in the turbine vane assemblies.

18 Claims, 9 Drawing Sheets

(56) References Cited

U.S. PATENT DOCUMENTS

| | | | | |
|---|---|---|---|---|
| 2015/0071783 | A1 | 3/2015 | Ahmad et al. | |
| 2016/0003101 | A1 | 1/2016 | Care et al. | |
| 2019/0338660 | A1* | 11/2019 | Underwood | F01D 9/041 |

* cited by examiner

TURBINE VANE ASSEMBLY WITH REINFORCED END WALL JOINTS

CROSS REFERENCE TO RELATED APPLICATIONS

This application is a divisional of U.S. patent application Ser. No. 16/133,226, filed Sep. 17, 2018, the disclosure of which is expressly incorporated herein by reference.

FIELD OF THE DISCLOSURE

The present disclosure relates generally to gas turbine engines, and more specifically, to turbine vane assemblies used in gas turbine engines.

BACKGROUND

Gas turbine engines are used to power aircraft, watercraft, power generators, and the like. Gas turbine engines typically include a compressor, a combustor, and a turbine. The compressor compresses air drawn into the engine and delivers high pressure air to the combustor. In the combustor, fuel is mixed with the high pressure air and is ignited. Products of the combustion reaction in the combustor are directed into the turbine where work is extracted to drive the compressor and, sometimes, an output shaft. Left-over products of the combustion are exhausted out of the turbine and may provide thrust in some applications.

Products of the combustion reaction directed into the turbine flow over airfoils included in stationary vanes and rotating blades of the turbine. The interaction of combustion products with the airfoils heats the airfoils to temperatures that require the airfoils to be made from high-temperature resistant materials and/or to be actively cooled by supplying relatively cool air to the vanes and blades. To this end, some airfoils for vanes and blades are incorporating composite materials adapted to withstand very high temperatures. Design and manufacture of vanes and blades from composite materials presents challenges because of the geometry and strength required for the parts.

SUMMARY

The present disclosure may comprise one or more of the following features and combinations thereof.

A turbine vane assembly for use in a gas turbine engine may include an airfoil and an end wall. The airfoil comprises ceramic matrix composite materials having ceramic-containing fibers infiltrated with ceramic matrix and is shaped to redirect hot gasses moving through a primary gas path within the gas turbine engine. The end wall also comprises ceramic matrix composite materials having ceramic-containing fibers co-infiltrated with ceramic matrix along with the airfoil and is shaped to define a flow path surface of the primary gas path.

In some embodiments, the turbine vane assembly further includes reinforcements interconnecting the airfoil and the end wall and strengthen a joint therebetween. The reinforcements may be stitched or tufted fibers. In other embodiments, the reinforcements may be rods or a reinforcement layer of braze material.

In some embodiments, the airfoil is shaped to include a leading edge and a trailing edge spaced radially apart of the leading edge. The airfoil also includes a pressure side having a concave shape that extends from the leading edge to the trailing edge and a suction side having a convex shape that extends form the leading edge to the trailing edge.

In some embodiments, the airfoil further includes an outer surface interfacing the hot gasses moving through the primary gas path, a central cavity extending through the airfoil, and an inner surface that faces the central cavity.

In some embodiments, the end wall includes a panel that extends circumferentially from the airfoil about a central axis to define a boundary of the primary gas path and a rim that extends radially from the panel outside the primary gas path.

In some embodiments, rim includes an outer surface that faces away from the outer surface of the airfoil and an inner surface that faces and runs along the outer surface of the airfoil.

In some embodiments, the reinforcements provided by the stitched fibers extend through at least one of the inner surface of the airfoil facing the central cavity of the airfoil and the outer surface of the rim that faces away from the airfoil. The stitched fibers are co-infiltrated with ceramic matrix along with the airfoil and the end wall.

In some embodiments, the reinforcements provided by the tufted fibers are pushed from one of the airfoil and the rim of the end wall into the other of the airfoil and the rim of the end wall. The tufted fibers are co-infiltrated with ceramic matrix along with the airfoil and the end wall.

In some embodiments, the reinforcements provided by the rods extend through the outer surface of the airfoil facing away from the central cavity of the airfoil and the inner surface of the rim that faces the airfoil. The rods comprise ceramic-containing materials and are co-infiltrated with ceramic matrix along with the airfoil and the end wall.

In some embodiments, the reinforcement provided by the reinforcement layer of braze material is arranged between the airfoil and the end wall.

In some embodiments, the ceramic-containing fibers of the airfoil and the end wall are included in a single woven component. The single woven component is infiltrated with ceramic matrix to create the reinforcement.

In some embodiments, the reinforcements are located on both the pressure side and the suction side of the airfoil. In other embodiments, the reinforcements are located on one of the pressure side of the airfoil and the suction side of the airfoil.

These and other features of the present disclosure will become more apparent from the following description of the illustrative embodiments.

DETAILED DESCRIPTION OF THE DRAWINGS

Figure 1:
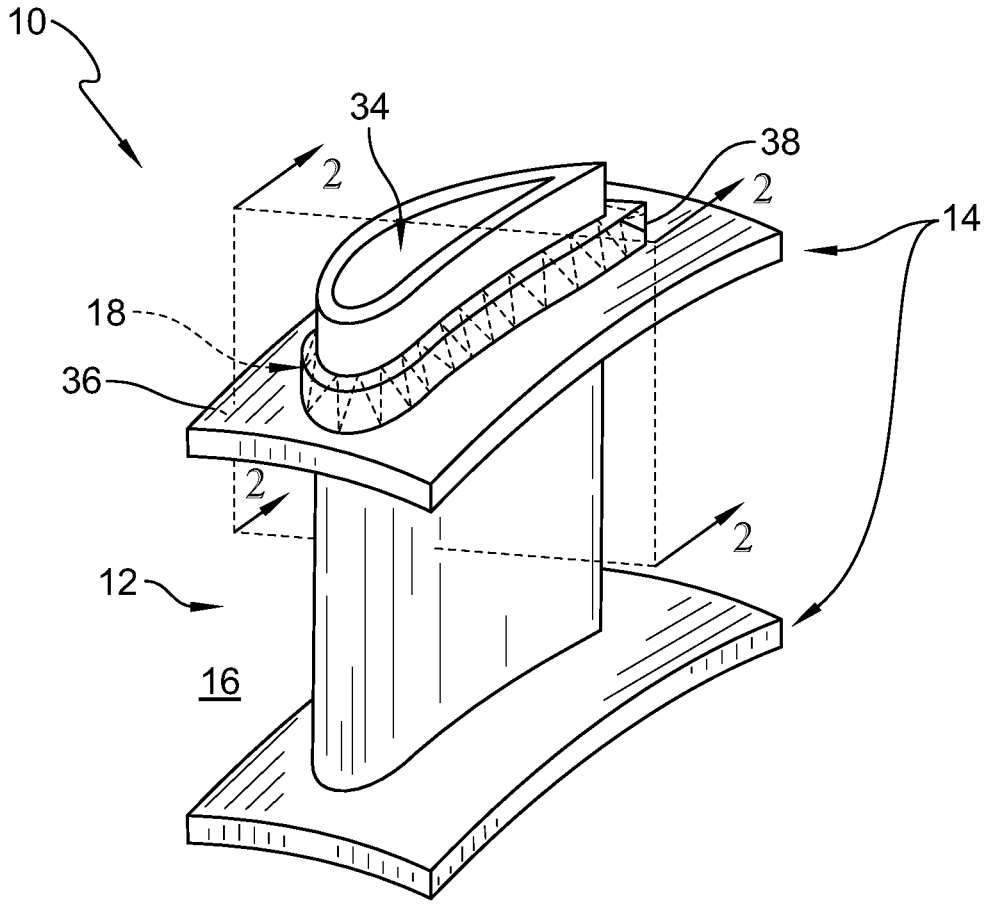
FIG. 1 is a perspective view of a turbine vane assembly comprising ceramic matrix composite material having ceramic-containing fibers for use in a gas turbine engine showing that the assembly includes an airfoil shaped to redirect hot gasses moving through the gas turbine engine, an end wall defining a boundary of a gas flow path, and reinforcements provided by stitched or tufted fibers to interconnect and the airfoil and end wall.

For the purposes of promoting an understanding of the principles of the disclosure, reference will now be made to a number of illustrative embodiments illustrated in the drawings and specific language will be used to describe the same.

An illustrative turbine vane assembly 10 extends partway about a central axis for use in a gas turbine engine as shown in FIG. 1. The turbine vane assembly 10 includes an airfoil 12 and an end wall 14. The airfoil 12 comprises ceramic matrix composite materials having ceramic-containing fibers infiltrated with ceramic matrix (e.g. silicon carbide fibers in silicon carbide matrix). The airfoil 12 is shaped to redirect hot gasses moving through a primary gas path 16 within the gas turbine engine. The end wall 14 also comprises ceramic matrix composite materials having ceramic-containing fibers co-infiltrated with ceramic matrix along with the ceramic-containing fibers of the airfoil 12. The end wall 14 is shaped to define a flow path surface of the primary gas path 16.

Figure 2:
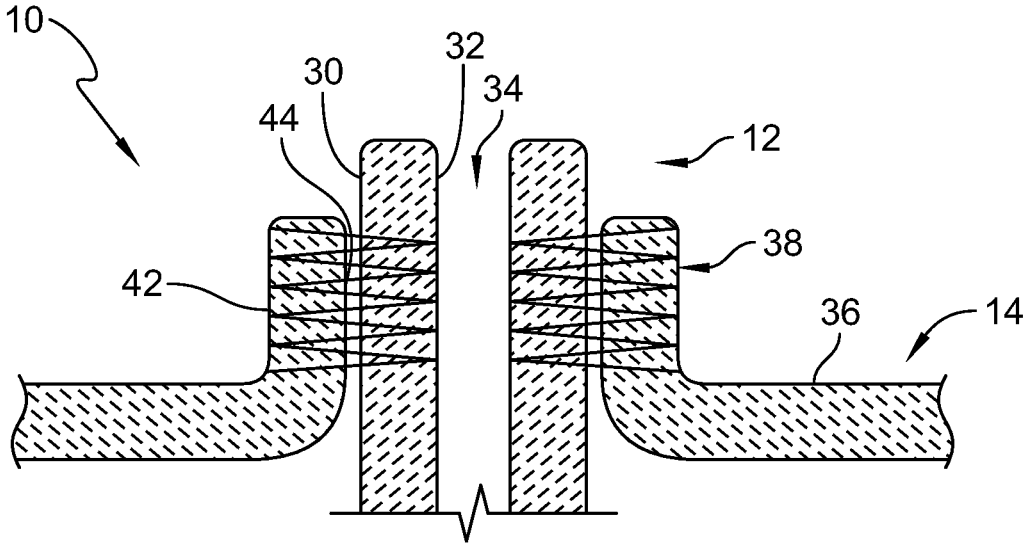
FIG. 2 is a cross-section view taken along the plane 2-2 in FIG. 1 showing the stitched or tufted fibers that are arranged to extend between an outer surface of the airfoil and a rim of the end wall to strength a joint therebetween.

The turbine vane assembly 10 further includes reinforcements 18 as shown in FIGS. 1 and 2. The reinforcements 18 are configured to interconnect the airfoil 12 and the end wall 14 and strengthen a joint therebetween. In the illustrative embodiment of FIGS. 1-3 the reinforcements 18 are provided by stitched fibers 20. In other embodiments, the reinforcement fibers are tufted fibers 20.

Figure 3:
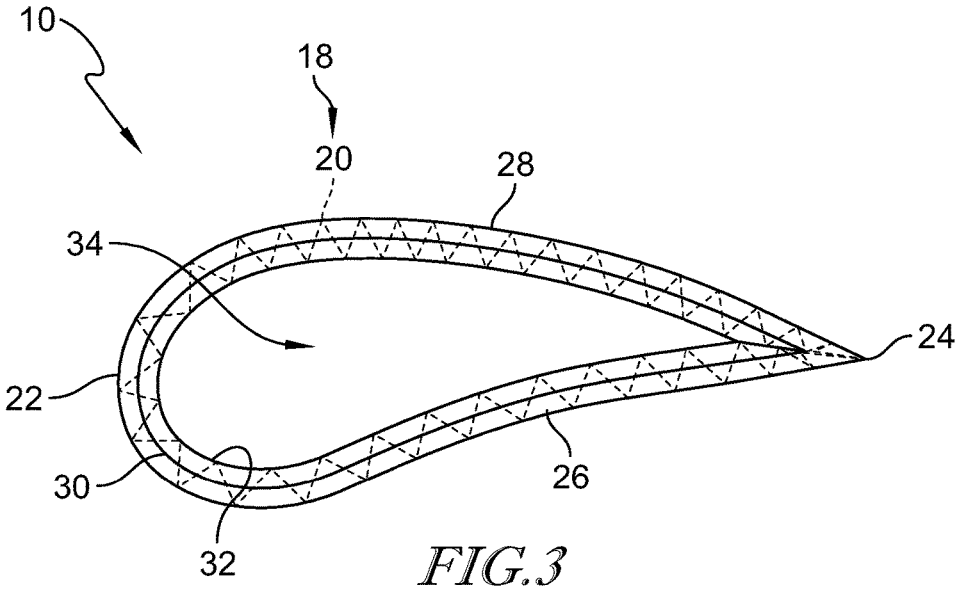
FIG. 3 is a top view of the turbine vane assembly of FIG. 1 showing that reinforcements extend between the airfoil and the end wall on both a pressure side and a suction side of the airfoil.

The airfoil 12 is shaped to include a leading edge 22 and a trailing edge 24 as shown in FIGS. 1 and 3. The trailing edge 24 is spaced radially apart from the leading edge 22. The airfoil also includes a pressure side 26 and a suction side 28 as shown in FIGS. 1 and 2. The pressure side 26 has a concave shape that extends from the leading edge 22 to the trailing edge 24. The suction side 28 has a convex shape that extends from the leading edge 22 to the trailing edge 24.

In the illustrative embodiment, the airfoil 12 also includes an outer surface 30, an inner surface 32, and a central cavity 34 as shown in FIGS. 1 and 2. The outer surface 30 interfaces the hot gasses moving through the primary gas path 16. The inner surface 32 faces a central cavity 34 of the airfoil 12. The central cavity 34 extends through the airfoil 12 and may allow cooling air to pass through the airfoil 12.

In the illustrative embodiment, the end wall 14 includes a panel 36 and a rim 38 as shown in FIGS. 1 and 2. The panel 36 extends circumferentially from the airfoil 12 about a central axis to define a boundary of the primary gas path 16. The rim 38 extends radially from the panel 36 outside the primary gas path 16 along the outer surface 30 of the airfoil 12. In the illustrative embodiment, the end wall 14 extends circumferentially beyond the rim 38 of the end wall 14.

The rim 38 includes an outer surface 42 and an inner surface 44 as shown in FIG. 2. The outer surface 42 faces away from the outer surface 30 of the airfoil 12. The inner surface 44 faces and runs along the outer surface 30 of the airfoil 12.

In the illustrative embodiment, the reinforcements 18 are provided by stitched fibers 20 that extend through (a) the inner surface 32 of the airfoil 12 facing the central cavity 34 of the airfoil 12 and/or (b) the outer surface 42 of the rim 38 that faces away from the airfoil 12 included in the end wall 14.

In the illustrative embodiment the stitched fibers are a continuous fiber stitched through the airfoil 12 and the rim 38 of the end wall 14. However, in other embodiments, the stitched fibers 20 may include several individual fibers 20 that extend through the rim 38 of the end wall from the outer surface 42 of the rim 38 and through the airfoil 12 to the inner surface 32 of the airfoil.

The stitched fibers 20 are co-infiltrated with ceramic matrix along with the airfoil 12 and the end wall 14. In the illustrative embodiment, the stitched fibers 20 that provide the reinforcements 28 are located only in the rim 38 such that they are radially apart from the panel 36.

Figure 3A:
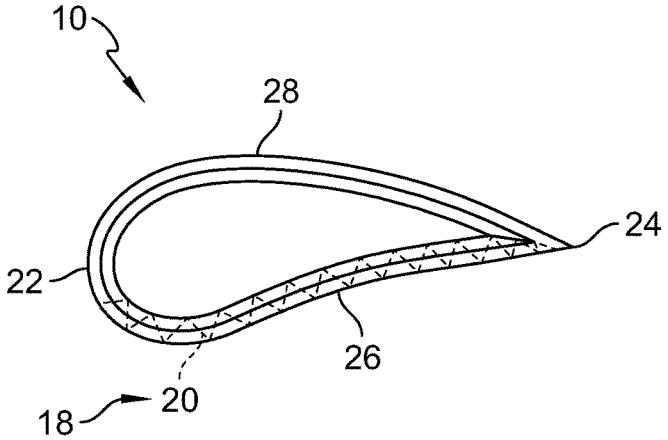
FIG. 3A is a top view of another embodiment of the turbine vane assembly of FIG. 1 showing that the reinforcements extend between the airfoil and the end wall on only the suction side of the airfoil body.
Figure 3B:
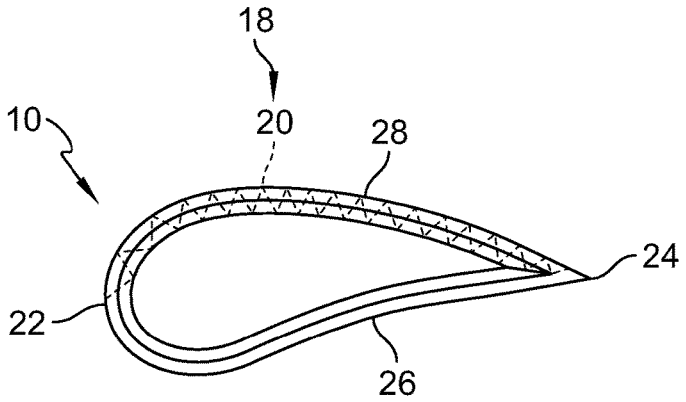
FIG. 3B is a top view of another embodiment of the turbine vane assembly of FIG. 1 showing that the reinforcements extend between the airfoil and the end wall on only the pressure side of the airfoil body.

The stitched fibers 20 that provide the reinforcements 18 may be located at different locations between the airfoil 12 and the end wall 14 as shown in FIGS. 3, 3A and 3B. In some embodiments, the stitched fibers 20 are located on both the pressure side 26 and the suction side 28 of the airfoil 12 as shown in FIG. 3. In other embodiments, the stitched fibers 20 are located only along the pressure side 26 of the airfoil 12 as shown in FIG. 3A. In other embodiments, the stitched fibers 20 are located only along the suction side 28 of the airfoil 12 as shown in FIG. 3B.

In other embodiments, the reinforcements 18 are provided by tufted fibers 20 pushed from the airfoil 12 and/or the rim 38 of the end wall 14 into the other of the airfoil 12 and/or the rim 38 of the end wall 14. The tufted fibers 20 are co-infiltrated with ceramic matrix along with the airfoil 12 and the end wall 14.

The tufted fibers 20 that provide the reinforcements 18 may be located at different locations between the airfoil 12 and the end wall 14 as shown in FIGS. 3, 3A and 3B. In some embodiments, the tufted fibers 20 are located on both the pressure side 26 and the suction side 28 of the airfoil 12 as shown in FIG. 3. In other embodiments, the tufted fibers 20 are located only along one of the pressure side 26 of the airfoil 12 and the suction side 28 of the airfoil 12.

Figure 4:
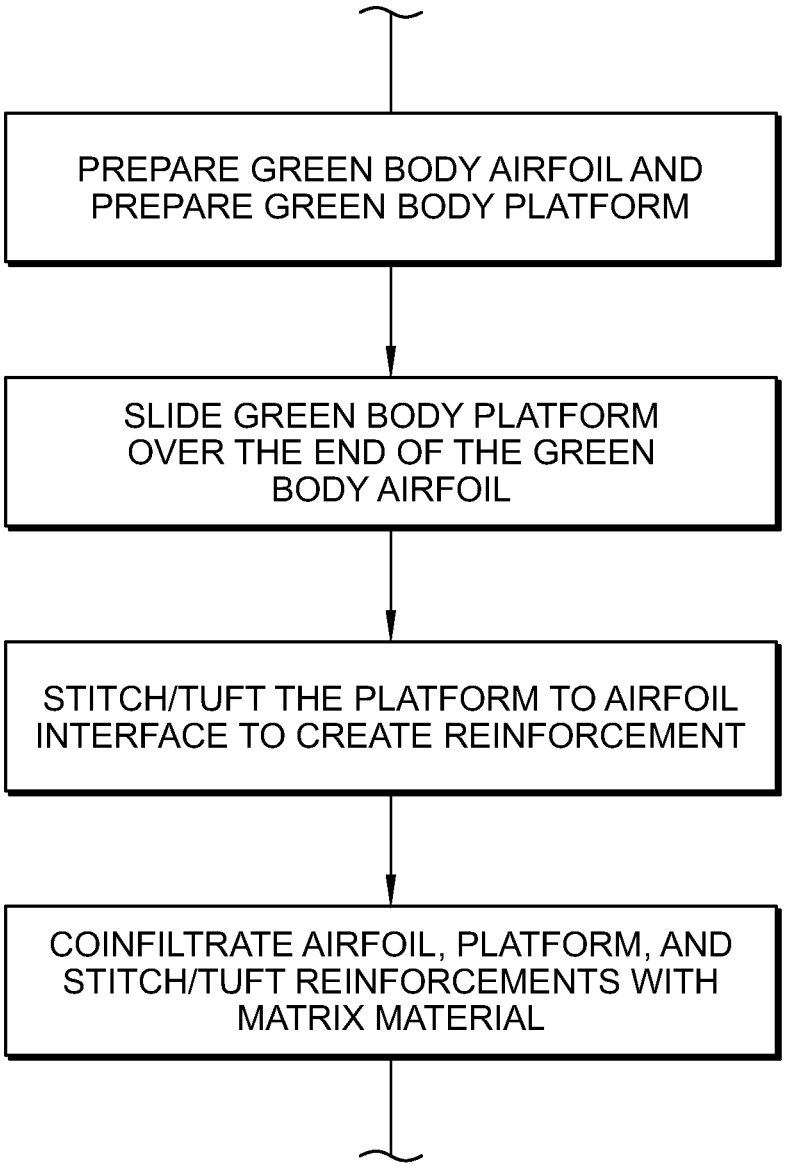
FIG. 4 is a block diagram of the steps of a process that may be used to form the turbine vane assembly of FIG. 1 with the reinforcement fibers.

A method of constructing the turbine vane assembly 10 adapted for use in the aerospace gas turbine engine with a central rotation axis includes several steps as shown in FIG. 4. The method begins with providing an airfoil preform 12 and providing an end wall preform 14.

The airfoil preform 12 is shaped to include a leading edge 22, a trailing edge 24, a pressure side 26, and a suction side 28 as shown in FIGS. 1-3. The pressure side 26 has a concave shape that extends from the leading edge 22 to the trailing edge 24. The suction side 28 has a convex shape that extends from the leading edge 22 to the trailing edge 24.

The end wall preform 14 includes a panel 36 and a rim 38 as shown in FIGS. 1 and 2. The panel 36 is shaped to extend circumferentially and axially from the rim 38 relative to the central axis.

The end wall preform 14 further includes an airfoil receiver aperture 40 as shown in FIGS. 1 and 2. The airfoil receiver aperture 40 extends radially away from the central axis through both the panel 36 and the rim 38.

The method continues with sliding the airfoil preform 12 into the airfoil receiver aperture 40 so that at least a portion of the airfoil 12 is received in the rim 38 of the end wall 14 and adding reinforcements 18 between the airfoil preform 12 and the rim 38 of the end wall preform 14. The last step of the method includes infiltrating the airfoil preform 12, the end wall preform 14, and the reinforcements 18 with ceramic matrix material. The infiltrating step may include infiltrating with one of chemical vapor infiltration, silicon melt infiltration, slurry infiltration, and/or a combination thereof.

The stitched fibers 20 extend through at least one of the inner surface 32 of the airfoil preform 12 facing the central cavity 34 of the airfoil preform 12 and the outer surface 42 of the rim 38 included in the end wall preform 14 into the other of the airfoil preform 12 and the rim 38 of the end wall preform 14.

In the illustrative embodiment, the adding the reinforcements 18 step includes stitching fibers across the interface of the airfoil preform 12 and the rim 38 of the end wall preform 14. In other embodiments, the adding reinforcements 18 step includes pushing fibers from one of the airfoil preform 12 and the rim 38 of the end wall preform 14 into the other of the airfoil preform 12 and the rim 38 of the end wall preform 14.

In some embodiments, the adding reinforcements step further includes adding the reinforcements 18 to both the pressure side 26 of the airfoil preform 12 and the suction side 28 of the airfoil preform 12. In other embodiments, the reinforcements 18 are located only along one of the pressure side 26 of the airfoil preform 12 and the suction side 28 of the airfoil preform 12.

Figure 5:
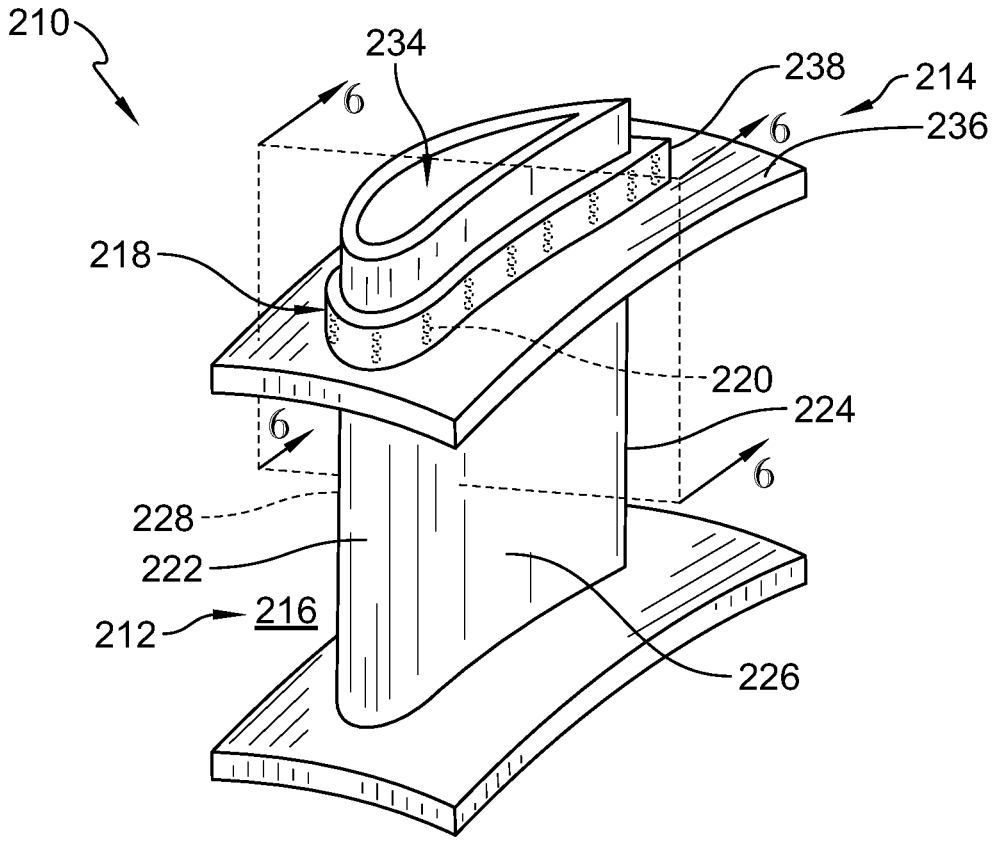
FIG. 5 is a perspective view of a second turbine vane assembly ceramic matrix composite material having ceramic-containing fibers for use in a gas turbine engine showing that the assembly includes an airfoil shaped to redirect hot gasses moving through the gas turbine engine, an end wall defining a boundary of a gas flow path, and reinforcements provided by rods to interconnect and the airfoil and end wall.

An illustrative second turbine vane assembly 210 extends partway about a central axis for use in a gas turbine engine as shown in FIG. 5. The turbine vane assembly 210 includes an airfoil 212 and an end wall 214. The airfoil 212 comprises ceramic matrix composite materials having ceramic-containing fibers infiltrated with ceramic matrix. The airfoil 212 is shaped to redirect hot gasses moving through a primary gas path 216 within the gas turbine engine. The end wall 214 also comprises ceramic matrix composite materials having ceramic-containing fibers con-infiltrated with ceramic matrix along with the ceramic-containing fibers of the airfoil 212. The end wall 214 is shaped to define a flow path surface of the primary gas path 216.

Figure 6:
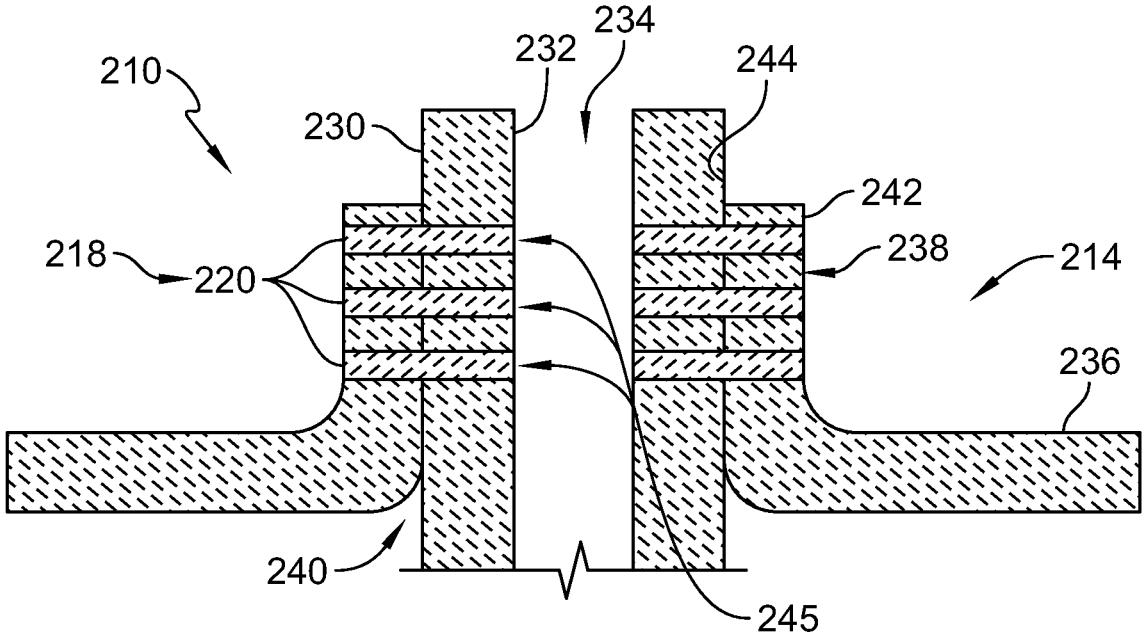
FIG. 6 is a cross-section view taken along the plane 6-6 in FIG. 5 showing the rods that are arranged to extend between an outer surface of the airfoil and a rim of the end wall to strength a joint therebetween.

The turbine vane assembly 210 further includes reinforcements 218 as shown in FIGS. 5 and 6. The reinforcements 218 are configured to interconnect the airfoil 212 and the end wall 214 and strengthen a joint therebetween. In the illustrative embodiment of FIGS. 5 and 6 the reinforcements 218 are provided by rods 220.

In some embodiments, the rods 220 may be individual fibers or monofilaments of greater diameter than the reinforcement fibers 18. In other embodiments, the rods 220, may be a grouping of tows or twisted tows. The rods 220 may comprise monolithic ceramic materials or may be three-dimensionally braided and/or woven cylinders.

The airfoil 212 is shaped to include a leading edge 222 and a trailing edge 224 as shown in FIGS. 1 and 2. The trailing edge 224 is spaced radially apart from the leading edge 222. The airfoil also includes a pressure side 226 and a suction side 228 as shown in FIGS. 5 and 6. The pressure side 226 has a concave shape that extends from the leading edge 222 to the trailing edge 224. The suction side 228 has a convex shape that extends from the leading edge 222 to the trailing edge 224.

In the illustrative embodiment, the airfoil 212 also includes an outer surface 230, an inner surface 232, and a central cavity 234 as shown in FIGS. 5 and 6. The outer surface 230 interfaces the hot gasses moving through the primary gas path 216. The inner surface 232 faces a central cavity 234 of the airfoil 212. The central cavity 234 extends through the airfoil 212 and may allow cooling air to pass through the airfoil 212.

In the illustrative embodiment, the end wall 214 includes a panel 236 and a rim 238 as shown in FIGS. 5 and 6. The panel 236 extends circumferentially from the airfoil 212 about a central axis to define a boundary of the primary gas path 216. The rim 238 extends radially from the panel 236 outside the primary gas path 216 along the outer surface 230 of the airfoil 212. In the illustrative embodiment, the end wall 214 extends circumferentially beyond the rim 238 of the end wall 214.

The rim 238 includes an outer surface 242, an inner surface 244, and rod receiving holes 245 as shown in FIG. 6. The outer surface faces away from the outer surface 230 of the airfoil 212. The inner surface 244 faces and runs along the outer surface 230 of the airfoil 212. The rod receiving holes 245 extend though the rim 238 and are configured to receive the rods 220 that provide the reinforcements 218.

The rods 220 that provide the reinforcements 218 extend through the outer surface 230 of the airfoil 212 facing away from the central cavity 234 of the airfoil 212 and the inner surface 244 of the rim that faces the airfoil 212 in the rod receiving holes 245. The rods 220 comprise ceramic-containing materials and are co-infiltrated with ceramic matrix along with the airfoil 212 and the end wall 214.

The rods 220 that provide the reinforcements 218 may be located at different locations between the airfoil 212 and the end wall 214. In some embodiments, the rods 220 are located on both the pressure side 226 and the suction side 228 of the airfoil 212 similar to the stitched or tufted fibers 20 in FIG. 3. In other embodiments, the rods 220 are located only along one of the pressure side 226 of the airfoil 212 and the suction side 228 of the airfoil 212 similar to the stitched or tufted fibers 20 in FIGS. 3A and 3B.

Figure 7:
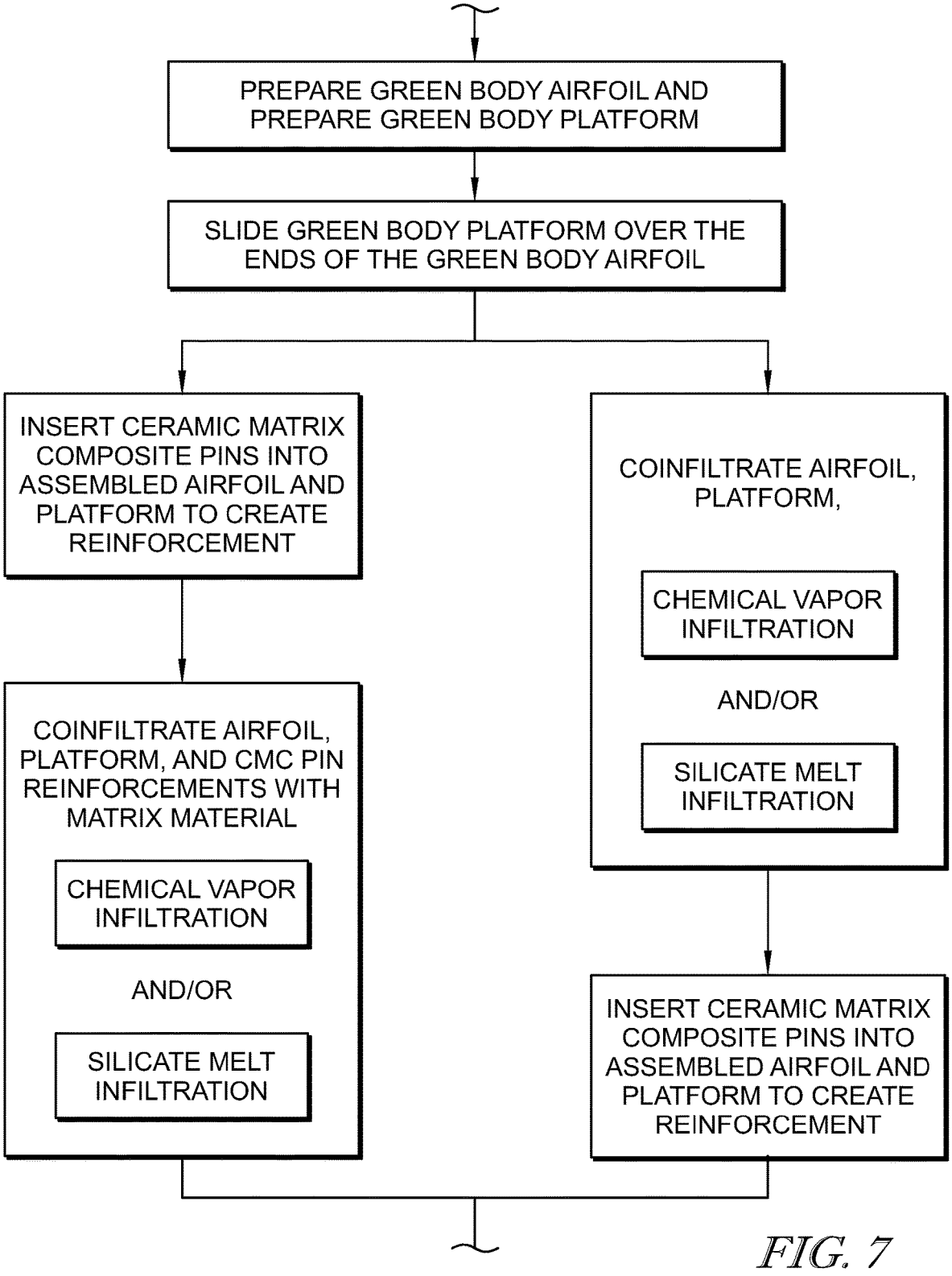
FIG. 7 is a block diagram of the steps of a process that may be used to form the turbine vane assembly of FIG. 5 with the reinforcement fibers.

A method of constructing the turbine vane assembly 210 adapted for use in the aerospace gas turbine engine with a central rotation axis includes several steps as shown in FIG. 7. The method begins with providing an airfoil preform 212 and providing an end wall preform 214.

The airfoil preform 212 is shaped to include a leading edge 222, a trailing edge 224, a pressure side 226, and a suction side 228 as shown in FIGS. 5 and 6. The pressure side 226 has a concave shape that extends from the leading edge 222 to the trailing edge 224. The suction side 228 has a convex shape that extends from the leading edge 222 to the trailing edge 224.

The end wall preform 214 includes a panel 236 and a rim 238 as shown in FIGS. 5 and 6. The panel 236 is shaped to extend circumferentially and axially from the rim 238 relative to the central axis.

The end wall preform 214 further includes an airfoil receiver aperture 240 as shown in FIGS. 5 and 6. The airfoil receiver aperture 240 extends radially away from the central axis through both the panel 236 and the rim 238.

The method continues with sliding the airfoil preform 212 into the airfoil receiver aperture 240 so that at least a portion of the airfoil 212 is received in the rim 238 of the end wall 214 and adding reinforcements 218 between the airfoil preform 212 and the rim 238 of the end wall preform 214. The last step of the method includes infiltrating the airfoil preform 212, the end wall preform 214, and the reinforcements 218 with ceramic matrix material. The infiltrating step may include infiltrating with one of chemical vapor infiltration, silicon melt infiltration, slurry infiltration, and/or a combination thereof.

In other embodiments, the method may instead include infiltrating the airfoil preform 212 and the end wall preform 214 before reinforcements 218 are added. Once the airfoil 212 and the end wall 214 have been infiltrated with ceramic matrix material, the method continues with adding the reinforcements 218 between the airfoil preform 212 and the rim 238 of the end wall preform 214.

In the illustrative embodiment, the adding the reinforcements 218 step includes pushing rods 220 across the interface of the airfoil preform 212 and the rim 238 of the end wall preform 214 into the rod receiving holes 245. In the illustrative embodiments, the rods 220 are equally spaced around the rim 238 of the end wall preform 214.

In some embodiments, the adding reinforcements step further includes adding the reinforcements 218 to both the pressure side 226 of the airfoil preform 226 and the suction side 228 of the airfoil preform 212. In other embodiments, the reinforcements 218 are located only along one of the pressure side 226 of the airfoil preform 212 and the suction side 228 of the airfoil preform 212.

Figure 8:
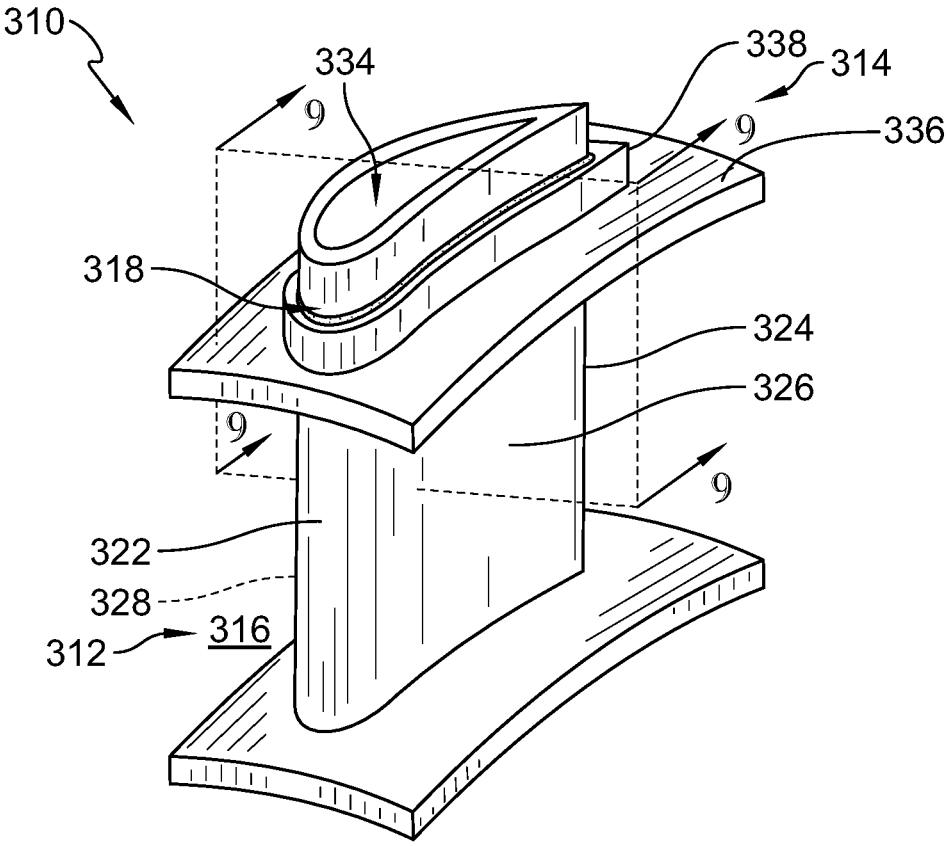
FIG. 8 is a perspective view of a third turbine vane assembly ceramic matrix composite material having ceramic-containing fibers for use in a gas turbine engine showing that the assembly includes an airfoil shaped to redirect hot gasses moving through the gas turbine engine, an end wall defining a boundary of a gas flow path, and reinforcements provided by a reinforcement layer of brazed material to interconnect and the airfoil and end wall.

An illustrative third turbine vane assembly 310 extends partway about a central axis for use in a gas turbine engine as shown in FIG. 8. The turbine vane assembly 310 includes a airfoil 312 and an end wall 314. The airfoil 312 comprises ceramic matrix composite materials having ceramic-containing fibers infiltrated with ceramic matrix. The airfoil 312 is shaped to redirect hot gasses moving through a primary gas path 316 within the gas turbine engine. The end wall 314 also comprises ceramic matrix composite materials having ceramic-containing fibers con-infiltrated with ceramic matrix. The end wall 314 is shaped to define a flow path surface of the primary gas path 316.

Figure 9:
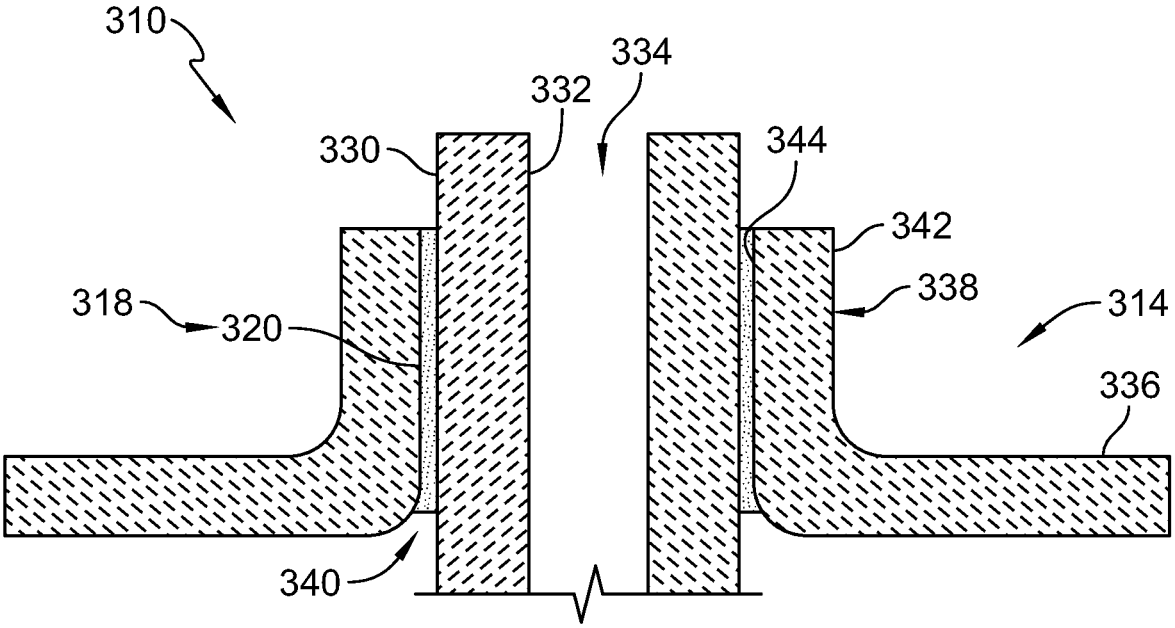
FIG. 9 is a cross-section view taken along the plane 9-9 in FIG. 8 showing the reinforcement layer that is arranged to extend between an outer surface of the airfoil and a rim of the end wall to strength a joint therebetween.

The turbine vane assembly 310 further includes reinforcements 318 as shown in FIGS. 8 and 9. The reinforcements 318 are configured to interconnect the airfoil 312 and the end wall 314 and strengthen a joint therebetween. In the illustrative embodiment of FIGS. 8 and 9 the reinforcements 318 are provided by a reinforcement layer of braze material 320 arranged between the airfoil 312 and the end wall 14.

The airfoil 312 is shaped to include a leading edge 322 and a trailing edge 324 as shown in FIGS. 8 and 9. The trailing edge 324 is spaced radially apart from the leading edge 322. The airfoil 312 also includes a pressure side 326 and a suction side 328 as shown in FIGS. 8 and 9. The pressure side 326 has a concave shape that extends from the leading edge 322 to the trailing edge 324. The suction side 328 has a convex shape that extends from the leading edge 322 to the trailing edge 324.

In the illustrative embodiment, the airfoil 312 also includes an outer surface 330, an inner surface 332, and a central cavity 334 as shown in FIGS. 58 and 9. The outer surface 230 interfaces the hot gasses moving through the primary gas path 316. The inner surface 332 faces a central cavity 334 of the airfoil 312. The central cavity 334 extends through the airfoil 312 and may allow cooling air to pass through the airfoil 312.

In the illustrative embodiment, the end wall 314 includes a panel 336 and a rim 338 as shown in FIGS. 8 and 9. The panel 336 extends circumferentially from the airfoil 312 about a central axis to define a boundary of the primary gas path 316. The rim 338 extends radially from the panel 336 outside the primary gas path 316 along the outer surface 330 of the airfoil 312. In the illustrative embodiment, the end wall 314 extends circumferentially beyond the rim 338 of the end wall 314.

The rim 338 includes an outer surface 342 and an inner surface 344 as shown in FIG. 9. The outer surface faces away from the outer surface 330 of the airfoil 312. The inner surface 344 faces and runs along the outer surface 330 of the airfoil 312. The layer of braze material 320 that provide the reinforcements 318 bond the outer surface 330 of the airfoil 312 facing away from the central cavity 334 of the airfoil 312 and the inner surface 344 of the rim 338 that faces the airfoil 312.

The reinforcement layer 320 that provides the reinforcements 318 may be located at different locations between the airfoil 312 and the end wall 314. In some embodiments, the reinforcement layer 320 is located on both the pressure side 326 and the suction side 328 of the airfoil 312 similar to the stitched or tufted fibers 20 in FIG. 3. In other embodiments, the reinforcement layer 320 is located only along one of the pressure side 326 of the airfoil 312 and the suction side 328 of the airfoil 312 similar to the stitched or tufted fibers 20 in FIGS. 3A and 3B.

Figure 10:
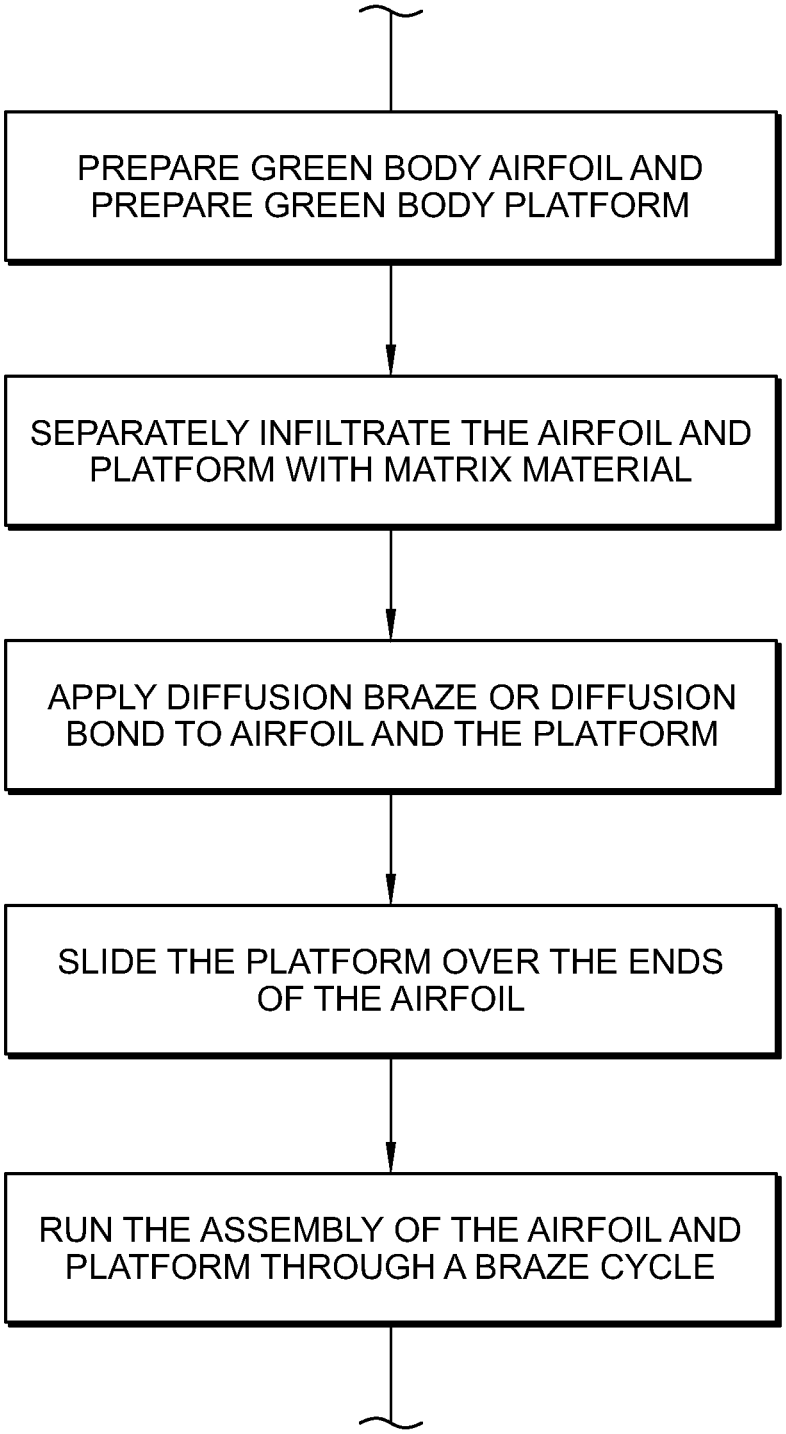
FIG. 10 is a block diagram of the steps of a process that may be used to form the turbine vane assembly of FIG. 8 with the reinforcement fibers.

A method of constructing the turbine vane assembly 310 adapted for use in the aerospace gas turbine engine with a central rotation axis includes several steps as shown in FIG. 10. The method begins with providing an airfoil preform 312 and providing an end wall preform 314.

The airfoil preform 312 is shaped to include a leading edge 322, a trailing edge 324, a pressure side 326, and a suction side 328 as shown in FIGS. 8 and 9. The pressure side 326 has a concave shape that extends from the leading edge 322 to the trailing edge 324. The suction side 328 has a convex shape that extends from the leading edge 322 to the trailing edge 324.

The end wall preform 314 includes a panel 336 and a rim 338 as shown in FIGS. 8 and 9. The panel 336 is shaped to extend circumferentially and axially from the rim 338 relative to the central axis.

The end wall preform 314 further includes an airfoil receiver aperture 340 as shown in FIGS. 8 and 9. The airfoil receiver aperture 340 extends radially away from the central axis through both the panel 336 and the rim 338.

The method continues separately infiltrating the airfoil preform 312 and the end wall preform 314 with ceramic matrix material. The infiltrating step may include infiltrating with one of chemical vapor infiltration, silicon melt infiltration, slurry infiltration, and/or a combination thereof. The method continues by adding reinforcements 318 between the airfoil preform 312 and the rim 338 of the end wall preform 314 before sliding the airfoil preform 312 into the airfoil receiver aperture 340 so that at least a portion of the airfoil 312 is received in the rim 338 of the end wall 314 to braze the airfoil preform 312 and the end wall 314 together to form a single component. The last step of the method includes running the assembly 420 through a braze cycle to bond the components together to form the single component.

In the illustrative embodiment, the adding the reinforcements 218 step includes adding the reinforcement layer of braze material 320 between the interface of the airfoil preform 312 and the rim 338 of the end wall preform 314.

In some embodiments, the adding reinforcements step further includes adding the reinforcements 318 to both the pressure side 326 of the airfoil preform 326 and the suction side 328 of the airfoil preform 312. In other embodiments, the reinforcements 318 are located only along one of the pressure side 326 of the airfoil preform 312 and the suction side 328 of the airfoil preform 312.

Figure 11:
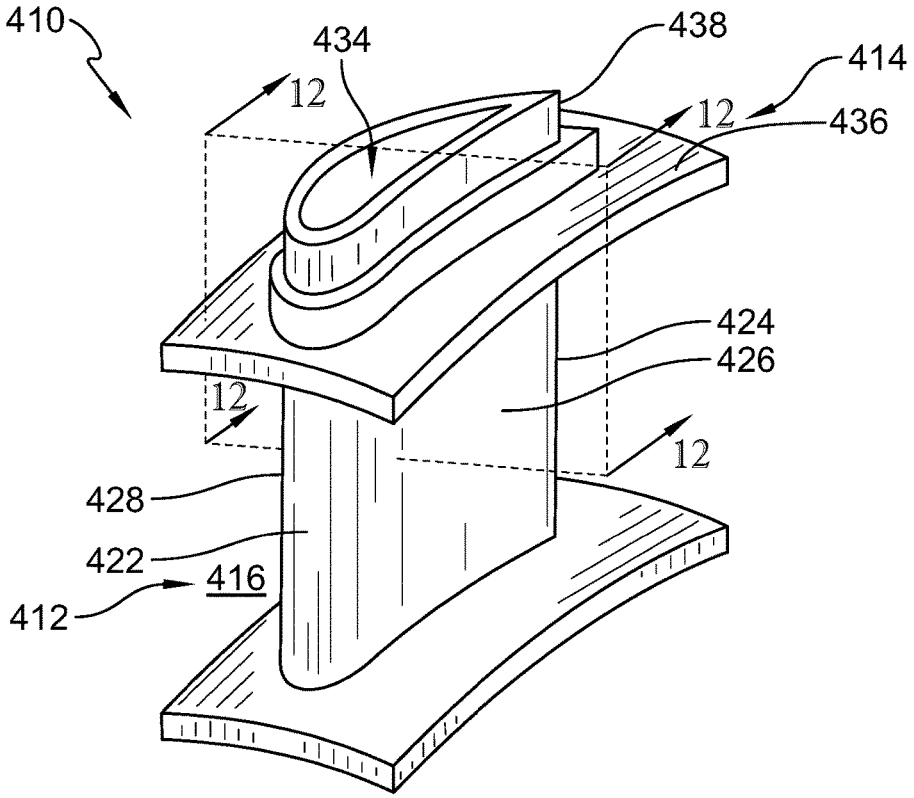
FIG. 11 is a perspective view of a fourth turbine vane assembly ceramic matrix composite material having ceramic-containing fibers for use in a gas turbine engine showing that the assembly includes an airfoil shaped to redirect hot gasses moving through the gas turbine engine and an end wall defining a boundary of a gas flow path and showing that the airfoil and the end wall are a single woven component.

An illustrative fourth turbine vane assembly 410 extends partway about a central axis for use in a gas turbine engine as shown in FIG. 11. The turbine vane assembly 410 includes a airfoil 412 and an end wall 414. The airfoil 412 comprises ceramic matrix composite materials having ceramic-containing fibers infiltrated with ceramic matrix. The airfoil 412 is shaped to redirect hot gasses moving through a primary gas path 416 within the gas turbine engine. The end wall 414 also comprises ceramic matrix composite materials having ceramic-containing fibers coninfiltrated with ceramic matrix along with the ceramic-containing fibers of the airfoil 412. The end wall 414 is shaped to define a flow path surface of the primary gas path 416.

Figure 12:
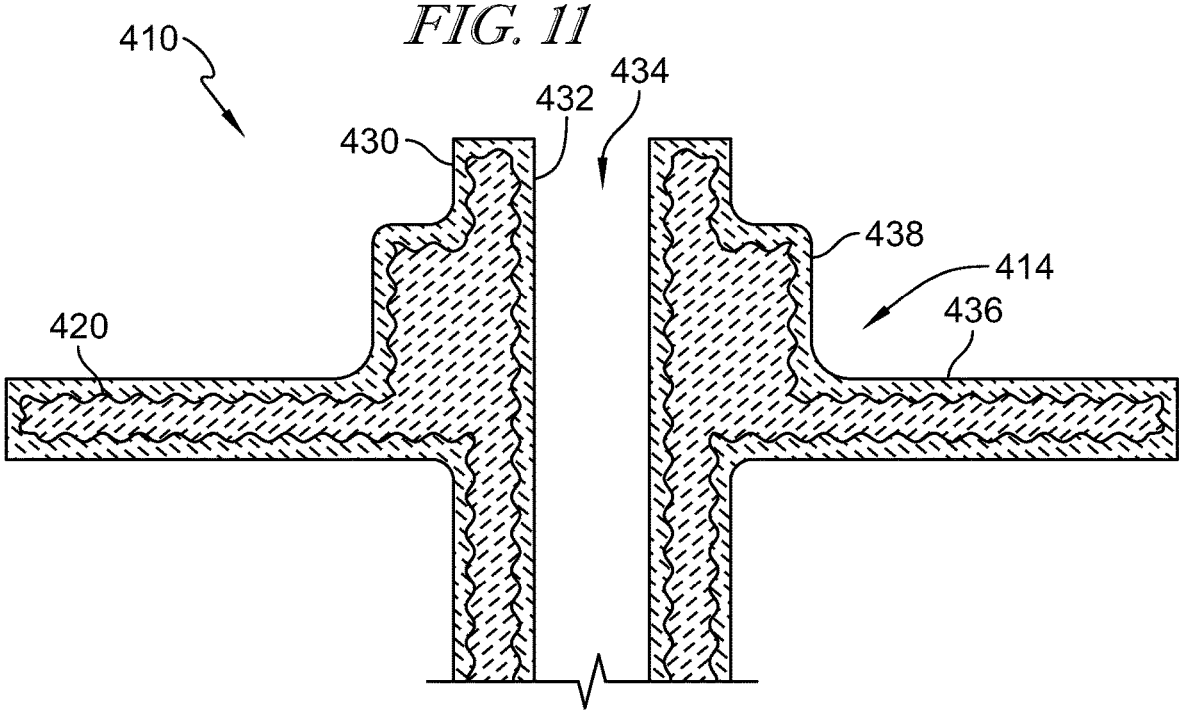
FIG. 12 is a cross-section view take along the plane 12-12 in FIG. 11 showing that the airfoil and the end wall are integrally three-dimensionally woven together create the reinforcement.

In the illustrative embodiment of FIGS. 11 and 12, the ceramic-containing fibers of the airfoil 12 and the ceramic-containing fibers of the end wall 14 are included in a single woven component 420. The single woven component 420 reinforces the turbine vane assembly 410.

The airfoil 412 is shaped to include a leading edge 422 and a trailing edge 424 as shown in FIGS. 11 and 12. The trailing edge 424 is spaced radially apart from the leading edge 422. The airfoil 412 also includes a pressure side 426 and a suction side 428 as shown in FIGS. 11 and 12. The pressure side 426 has a concave shape that extends from the leading edge 422 to the trailing edge 424. The suction side 428 has a convex shape that extends from the leading edge 422 to the trailing edge 424.

In the illustrative embodiment, the airfoil 412 also includes an outer surface 430, an inner surface 432, and a central cavity 434 as shown in FIGS. 11 and 12. The outer surface 430 interfaces the hot gasses moving through the primary gas path 416. The inner surface 432 faces a central cavity 434 of the airfoil 412. The central cavity 434 extends through the airfoil 412 and may allow cooling air to pass through the airfoil 412.

In the illustrative embodiment, the end wall 414 includes a panel 436 and a rim 438 as shown in FIGS. 11 and 12. The panel 436 extends circumferentially from the airfoil 412 about a central axis to define a boundary of the primary gas path 416. The rim 438 extends radially from the panel 436 outside the primary gas path 416 along the outer surface 430 of the airfoil 412. In the illustrative embodiment, the end wall 414 extends circumferentially beyond the rim 438 of the end wall 414.

Figure 13:
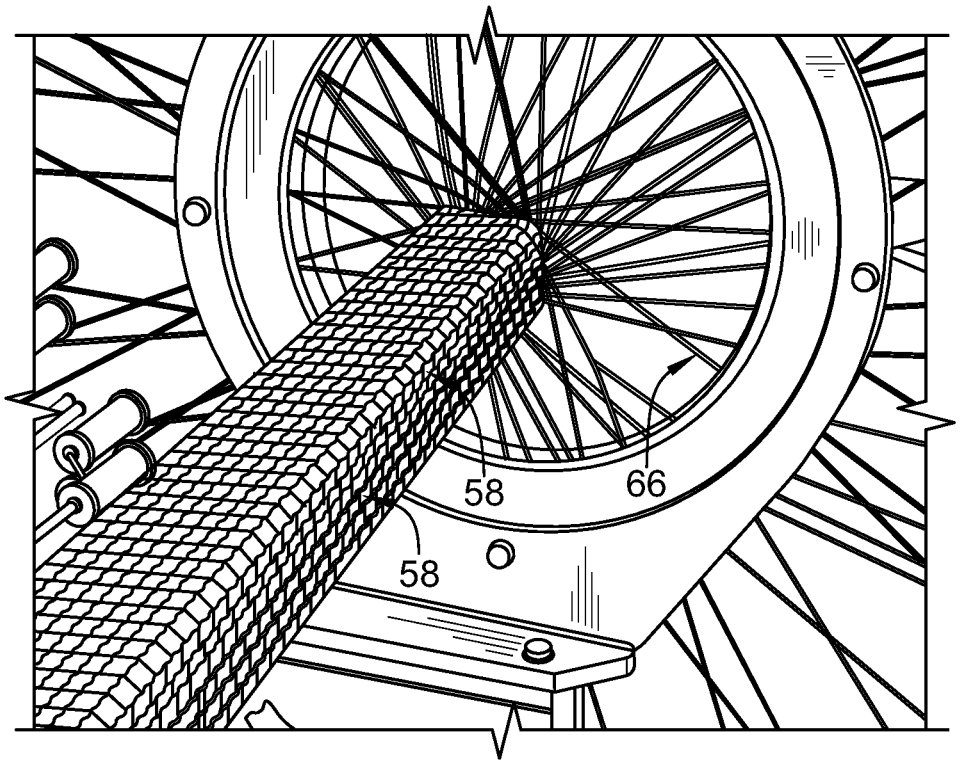
FIG. 13 is a perspective view of an example of a three-dimensional (3D) braiding process for braiding the reinforcement of the integral airfoil and end wall.
Figure 14:
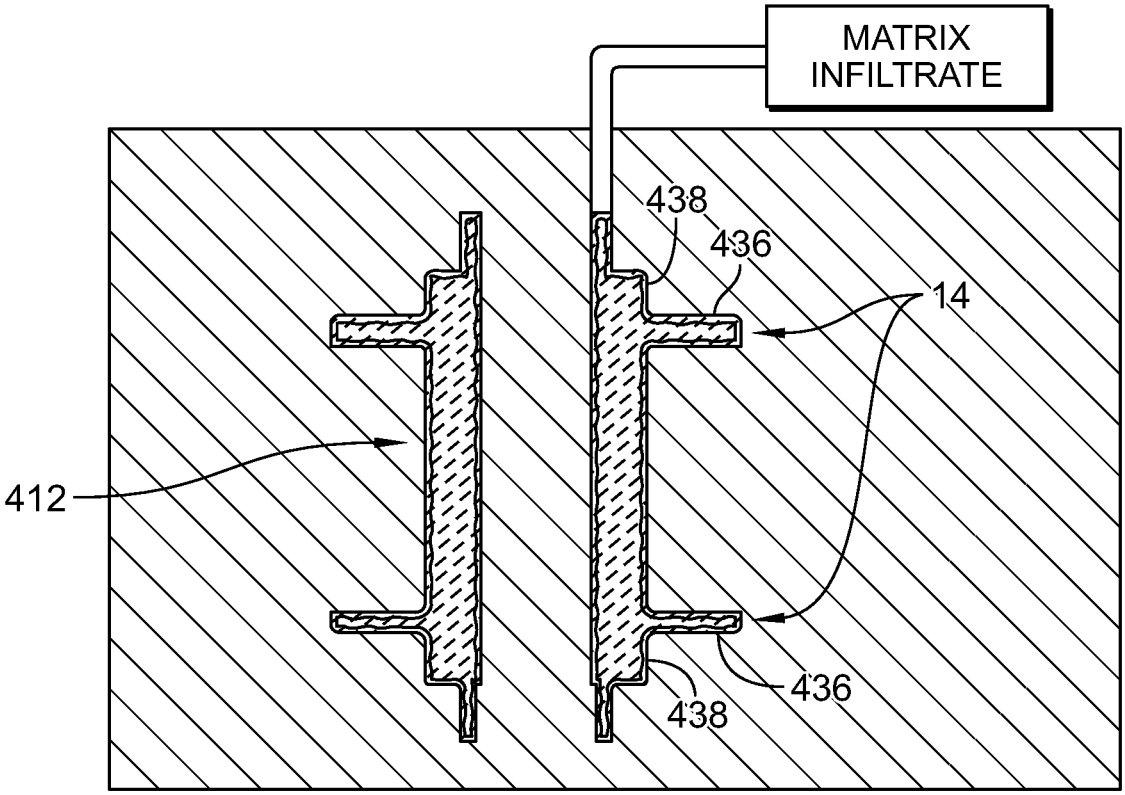
FIG. 14 is a sectional view of a mold cavity used to infuse the braided airfoil and end walls with a matrix to form the composite integral airfoil and end walls.

A method of constructing the turbine vane assembly 410 adapted for use in the aerospace gas turbine engine with a central rotation axis includes several steps as shown in FIGS. 13 and 14. The method begins with three-dimensionally braiding an airfoil preform 412 and providing an end wall preform 414 to form a single woven component 420 as shown in FIG. 13.

The airfoil preform 412 is shaped to include a leading edge 422, a trailing edge 424, a pressure side 426, and a suction side 428 as shown in FIGS. 11 and 12. The pressure side 426 has a concave shape that extends from the leading edge 422 to the trailing edge 424. The suction side 428 has a convex shape that extends from the leading edge 422 to the trialing edge 424.

The end wall preform 414 includes a panel 436 and a rim 438 as shown in FIGS. 11 and 12. The panel 436 is shaped to extend circumferentially and axially from the rim 438 relative to the central axis. In some embodiments, the rim 348 may be configured to mount the turbine vane assembly 420 in the gas turbine engine 10.

In some embodiments, the rim 438 may also act as a seal once mounted in the engine 10. Additionally, the rim 438 may also be configured to control the temperature or stresses in the turbine vane assembly 420. In other embodiments, the rim 438 may not be included in the end wall preform 414.

The end wall preform 414 further includes an airfoil receiver aperture 440 as shown in FIGS. 11 and 12. The airfoil receiver aperture 440 extends radially away from the central axis through both the panel 436 and the rim 438.

The method continues with infiltrating the single woven component 420 including the airfoil preform 412 and the end wall preform 414 with ceramic matrix material. The infiltrating step may include infiltrating with one of chemical vapor infiltration, silicon melt infiltration, slurry infiltration, and/or a combination thereof.

The present disclosure related to nozzle guide vanes including an airfoil, an inner platform, and an outer platform. The airfoil, the inner platform, and the out platform could be manufactured individually and assembled together or could be fabricated as one-piece. If manufactured as one-piece the airfoil may protrude through the platforms.

Due to the secondary air system architecture, the platforms will be loaded radially towards the gas path. The radial loading of the platforms results in significant stresses on the joint between the airfoil and the platform. Without reinforcement, the resulting stress imparted on the joint would cause significant damage to accumulate in the joint. Thus, the joint would unlikely meet the life requirements associated with nozzle guide vanes as the joint would be reliant on the matrix properties of the airfoil and the platforms. The matrix material would then act as a monolithic ceramic and would fail in a catastrophic, brittle manner.

A reinforcement 18, 218, 318, 418 at the interface of the airfoil and the platform may increase the load carrying capability and the toughness of the joint, directly improving the integrity of the joint. The reinforcements may also reduce the impact of any environmental deterioration in the joint region.

The reinforced airfoil and the platforms may be created by co-processing and joining the airfoil and the platforms with silicon melt infiltration. Co-processing and joining with silicon melt infiltration would result in an optimized platform to airfoil joint contact area. In some embodiments, the co-processing and joining of the airfoil and platforms may be with one of chemical vapor infiltration, silicon melt infiltration, slurry infiltration, and/or a combination thereof.

In some embodiments, the reinforced airfoil and the platforms may be created by installing ceramic matrix composite pins or rods and co-processing the airfoil, platforms, and pins with chemical vapor infiltration and then silicone melt infiltration or just silicon melt infiltration. In other embodiments, the ceramic matrix composite pins may be installed post-ceramic matrix composite manufacturing of the airfoil and the platform. In other embodiments, the pins or rods may be rod preforms or fully processed rods and either may be installed in the airfoil and platform at any point in time during the assembling of the turbine vane assembly.

In other embodiments, the reinforced airfoil and platforms may be created by stitching or tufting through the joint or brazing the airfoil and the platforms together. In other embodiments, the reinforced airfoil and platforms may be created by combining installing ceramic matrix composite pins or rods and brazing the joint between the airfoil and the platform together. The airfoil and the platform preforms will be processed separately and the braze layer added before the airfoil and the platform are assembled together. Then pins would then be installed and brazed in place. In some embodiments, the airfoil and the platforms may be three-dimensionally woven to form a single component.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A turbine vane adapted for use in an aerospace gas turbine engine, the turbine vane comprising an airfoil comprising ceramic matrix composite materials having ceramic-containing fibers infiltrated with ceramic matrix, the airfoil shaped to redirect hot gasses moving along a primary gas path within the aerospace gas turbine engine, an end wall comprising ceramic matrix composite materials having ceramic-containing fibers co-infiltrated with ceramic matrix along with the ceramic-containing fibers of the airfoil, the end wall including a panel that extends circumferentially from the airfoil about a central axis to define a boundary of the primary gas path and a rim that extends radially from the panel outside the primary gas path along an outer surface of the airfoil, and reinforcements configured to interconnect the airfoil and the end wall and strengthen a joint therebetween, the reinforcements arranged to extend between the outer surface of the airfoil and the rim of the end wall, wherein the reinforcements are provided by sets of rods spaced apart around the rim of the end wall, each of the sets of rods include a first rod, a second rod spaced radially outward of the first rod, and a third rod spaced radially outward of the second rod.

2. The turbine vane of claim 1, wherein the reinforcements are provided by rods of the sets of rods that extend through the outer surface of the airfoil facing away from a central cavity of the airfoil and an inner surface of the rim that faces the airfoil, wherein the airfoil is shaped to include a leading edge, a trailing edge, a pressure side having a concave shape that extends from the leading edge to the trailing edge, and a suction side having a convex shape that extends from the leading edge to the trailing edge, and wherein the rods that provide the reinforcements are located only along one of the pressure side of the airfoil and the suction side of the airfoil.

3. The turbine vane of claim 1, wherein each rod of the sets of rods comprises ceramic-containing material.

4. The turbine vane of claim 3, wherein each rod of the sets of rods is one of a monofilament, a grouping of twisted tows, and a three-dimensionally braided cylinder.

5. The turbine vane of claim 1, wherein each rod of the sets of rods is co-infiltrated with ceramic matrix along with the airfoil and the end wall.

6. The turbine vane of claim 1, wherein the reinforcements are arranged to extend through an inner surface of the airfoil facing a central cavity of the airfoil and an outer surface of the rim of the end wall that faces away from the airfoil.

7. A turbine vane adapted for use in an aerospace gas turbine engine, the turbine vane comprising an airfoil comprising ceramic matrix composite materials having ceramic-containing fibers infiltrated with ceramic matrix, the airfoil shaped to redirect hot gasses moving along a primary gas path within the aerospace gas turbine engine, an end wall comprising ceramic matrix composite materials having ceramic-containing fibers co-infiltrated with ceramic matrix along with the ceramic-containing fibers of the airfoil, the end wall including a panel that extends circumferentially from the airfoil about a central axis to define a boundary of the primary gas path and a rim that extends radially from the panel outside the primary gas path along an outer surface of the airfoil, and reinforcements configured to interconnect the airfoil and the end wall and strengthen a joint therebetween, wherein the reinforcements are provided by rods arranged to extend through an inner surface of the airfoil facing a central cavity of the airfoil and an outer surface of the rim of the end wall that faces away from the airfoil;

wherein the reinforcements provided by the rods are sets of rods spaced apart around the rim of the end wall, each of the sets of rods include a first rod, a second rod spaced radially outward of the first rod, and a third rod spaced radially outward of the second rod.

8. The turbine vane of claim 7, wherein the rods comprise ceramic-containing material.

9. The turbine vane of claim 8, wherein each of the rods is one of a monofilament, a grouping of twisted tows, and a three-dimensionally braided cylinder.

10. The turbine vane of claim 8, wherein each of the rods is co-infiltrated with ceramic matrix along with the airfoil and the end wall.

11. The turbine vane of claim 7, wherein each of the rods has terminal ends that are flush with the outer surface of the rim.

12. The turbine vane of claim 7, wherein the airfoil includes a first set of rod-receiving holes that extend through the inner and outer surface of the airfoil, the rim of the end wall includes a second set of rod-receiving holes that that extend through the outer surface and an inner surface of the rim, and the first set of rod-receiving holes and the second set of rod-receiving holes are aligned to receive the rods that provide the reinforcements.

13. The turbine vane of claim 7, wherein the airfoil is shaped to include a leading edge, a trailing edge, a pressure side having a concave shape that extends from the leading edge to the trailing edge, and a suction side having a convex shape that extends from the leading edge to the trailing edge, and wherein the rods that provide the reinforcements are located only along the suction side of the airfoil.

14. The turbine vane of claim 7, wherein the airfoil is shaped to include a leading edge, a trailing edge, a pressure side having a concave shape that extends from the leading edge to the trailing edge, and a suction side having a convex shape that extends from the leading edge to the trailing edge, and wherein the rods that provide the reinforcements are located only along the pressure side of the airfoil.

15. The turbine vane of claim 7, wherein the sets of rods are equally spaced apart around the rim of the end wall.

16. A turbine vane adapted for use in an aerospace gas turbine engine, the turbine vane comprising an airfoil comprising ceramic matrix composite materials having ceramic-containing fibers infiltrated with ceramic matrix, the airfoil shaped to redirect hot gasses moving along a primary gas path within the aerospace gas turbine engine, an end wall comprising ceramic matrix composite materials having ceramic-containing fibers co-infiltrated with ceramic matrix along with the ceramic-containing fibers of the airfoil, the end wall including a panel that extends circumferentially from the airfoil about a central axis to define a boundary of the primary gas path and a rim that extends radially outward from the panel outside the primary gas path along an outer surface of the airfoil, and reinforcements configured to interconnect the airfoil and the end wall and strengthen a joint therebetween, the reinforcements arranged to extend between the outer surface of the airfoil and the rim of the end wall, wherein the airfoil is shaped to include a leading edge, a trailing edge, a pressure side having a concave shape that extends from the leading edge to the trailing edge, and a suction side having a convex shape that extends from the leading edge to the trailing edge, and wherein the leading edge, the trailing edge, the pressure side, and the suction side of the airfoil extend radially continuously from a radially inner end of the airfoil to a radially outermost end of the airfoil, wherein the rim includes an inner surface that forms an airfoil shaped aperture that receives the airfoil such that the inner surface abuts and extends entirely along the outer surface of the airfoil at the leading edge, the trailing edge, the pressure side, and the suction side of the airfoil, wherein the radially outermost end of the airfoil extends radially outward beyond a radially outermost end of the rim, and wherein the reinforcements are provided by sets of rods spaced apart around the rim of the end wall along the leading edge, the trailing edge, the pressure side, and the suction side of the airfoil.

17. The turbine vane of claim 16, wherein each of the sets of rods include a first rod, a second rod spaced radially outward of the first rod, and a third rod spaced radially outward of the second rod.

18. The turbine vane of claim 16, wherein each of the sets of rods are arranged to extend through the outer surface of the airfoil facing away from a central cavity of the airfoil and the inner surface of the rim that faces the airfoil.

* * * * *